US005083699A

United States Patent [19]

Bulcher

[11] Patent Number: 5,083,699

[45] Date of Patent: Jan. 28, 1992

[54] POP UP TAB TRAY WITH INTACK SHOULDER PORTION

[75] Inventor: David J. Bulcher, Powell, Ohio

[73] Assignee: Pressware International, Inc., Columbus, Ohio

[21] Appl. No.: 628,146

[22] Filed: Dec. 17, 1990

[51] Int. Cl.[5] ..... B65D 1/34

[52] U.S. Cl. ..... 229/2.5 R; 229/1.5 B; 229/125.17; 229/125.27

[58] Field of Search ..... 229/2.5 R, 125.27, 125.28, 229/125.17, 1.5 B, 125.09; 220/307

[56] References Cited

U.S. PATENT DOCUMENTS 3,349,950 10/1967 Wonderer ..... 220/307
4,026,458 5/1977 Morris et al. ..... 229/2.5 R
4,753,351 6/1988 Guillin ..... 220/307

*Primary Examiner*—Stephen Marcus
*Assistant Examiner*—Christopher J. McDonald
*Attorney, Agent, or Firm*—Frank H. Foster

[57] ABSTRACT

In a paperboard food container, especially the clamshell type used in the fast food industry, a releasably interlocking means between the container and a lid. The interlocking means includes a slot formed in the container which not only leaves a continuous, coplanar shoulder around the circumference of the container which allows complete sealing with a lid structure, but additionally provides a tab which extends above the slot, allowing the lid structure to have either a flange extending under the container tab or, in addition to the flange, a tab inserting into the slot.

3 Claims, 2 Drawing Sheets

FIG. 1
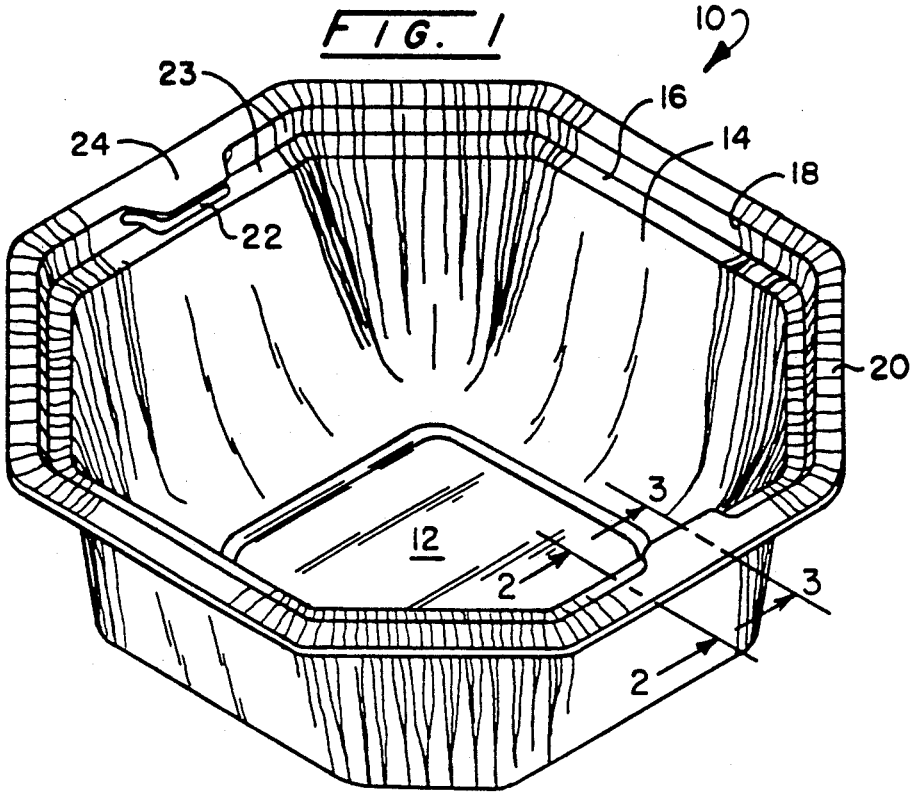
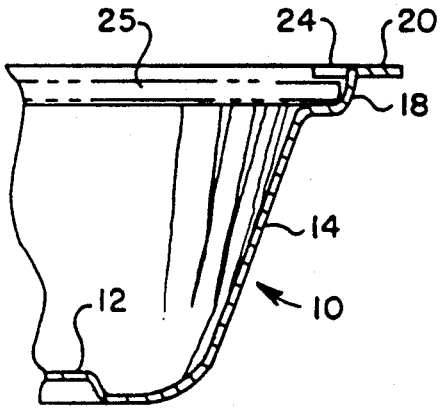
FIG. 2
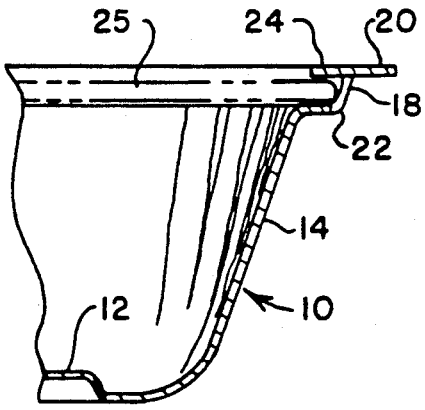
FIG. 3
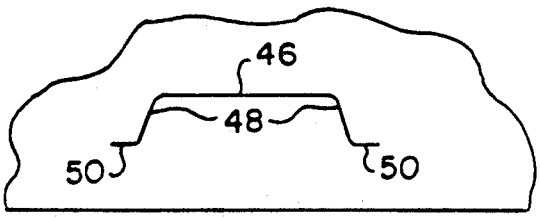
FIG. 6

POP UP TAB TRAY WITH INTACK SHOULDER PORTION

TECHNICAL FIELD

This invention relates to the field of compressed paperboard food trays and more specifically to a paperboard food tray having a releasably interlocking means for engaging a lid structure on a tray.

BACKGROUND ART

In the field of paperboard food containers which are typically formed by compressing paperboard blanks between dies, there is a need, especially in the fast food industry, for effective sealing between a formed tray and its lid structure to maintain the temperature and moisture level of the contents of the container. This is accomplished by a locking means between a lid and the tray which can be easily engaged after the food is placed in the tray. After engagement, the food container should seal the contents from the environment, especially if the contents are hot, cold or spoilable. Additionally, the locking means should allow easy removal of the lid structure for access to the contents of the container.

Conventional embodiments of releasably interlocking means on paperboard containers includes a Peerless structure which is believed to be the subject of a patent application of another. The Peerless structure is of the clamshell variety and comprises a lower tray section having a slot near its upper ledge and a matingly formed lid structure having a tab which extends outwardly and into the slot during locking. While this releasably interlocking means is easily engaged and disengaged, the sealability of the container is inadequate. The poor sealing is due to an elevated ridge structure on the upper ledge at the slot means which prevents complete seating of the lid against the ledge of the lower tray. The elevated ridge structure is angled relative to the upper ledge at the slot, preventing the lid from contacting the upper ledge around the entire circumference of the tray. Additionally, the Peerless structure does not have a lid seating ledge near the slot, but merely an upwardly facing edge, of paperboard thickness, which is recessed downward from the lid seating ledge plane and therefore prevents sealing at the tab.

The need therefore exists for a releasably interlocking means on a food container which is easily engaged and disengaged, but most importantly accomplishes complete sealing of the contents of the container.

BRIEF DISCLOSURE OF INVENTION

This invention relates generally to a paperboard food container, and more specifically to one having, in an operable orientation, a horizontal bottom wall and side walls which extend upward from the edges of the bottom wall. A narrow step extends outwardly from the top of the side walls and encompasses the circumference of the tray. A rim extends upward from the step and a flange extends outwardly from the top of the rim. The invention is an improved releasably interlocking means comprising a slot formed outwardly of and spaced from the bend between the side wall and step. The slot extends into the rim and up to the flange, leaving a continuous coplanar step around the circumference of the container for continuously contacting a lid. The invention further comprises a tab which extends from the flange inwardly and above the slotted region for releasably interlocking with an outer edge of or an outwardly extending tab or flange on a lid.

BRIEF DESCRIPTION OF DRAWINGS

FIG. 1 is a view in perspective of the preferred embodiment of the present invention.

FIG. 2 is a section of the embodiment of FIG. 1 taken substantially through the line 2—2 of FIG. 1.

FIG. 3 is a section of the embodiment of FIG. 1 taken substantially through the line 3—3 of FIG. 1.

FIG. 6 is a top view illustrating the shape of the pre-cut portion of the paperboard blank.

Figure 4:
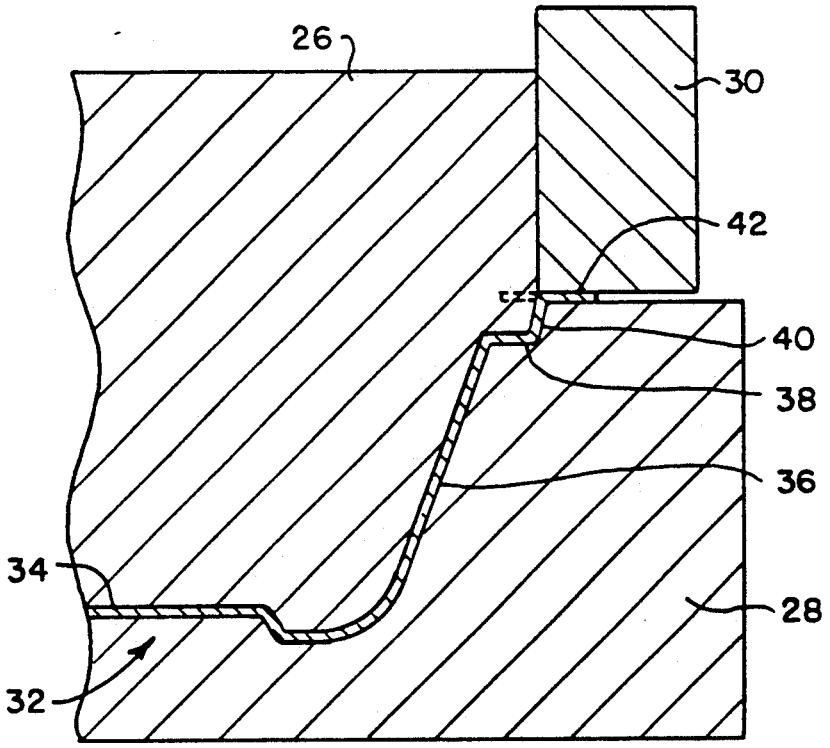
FIG. 4 is a section of the forming dies used to form the embodiment of FIG. 1 taken substantially through a line offset from the center of the dies.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose.

DETAILED DESCRIPTION

The preferred embodiment of the present invention is illustrated in FIG. 1. A paperboard tray 10 has, in an operable position shown in FIG. 1, a bottom 12. Sidewalls 4 extend upward from the bottom 12 at the edges of the bottom 12. A step 16 extends outwardly from the edges of the sidewalls 14 around the entire circumference of the tray 10. A rim 18 extends upward from the step 16 and a flange 20 extends outwardly from the rim 18.

A slot 22 is formed outwardly of and spaced from a bend 23 joining the sidewall 14 and the step 16. The slot 22 extends upwards into the rim 18, ending at the flange 20. A tab 24, having side edges which taper in, extends inwardly from and coplanar to the flange 20 and extending above the slot 22 formed in the step 16.

The step 16 is continuous around the circumference of the tray 10 and is contained in one plane, a plane generally parallel to the bottom 12 of the tray 10. The width of the step 16 at the slot 22 is somewhat less than the width of the step 16 around the rest of the circumference of the tray 10, but the step 16 retains enough width at the slot 22 to provide structural and sealing capabilities which are practically equal to those found in the step 16 around the remainder of the tray 10.

FIGS. 2 and 3 are sections made through the tray 10 of FIG. 1 at areas spaced to show the two possible sections given at two different locations on the tray 10. FIG. 2 is a section through the tray 10 of FIG. 1, spaced a distance from the slot 22 and shows the basic shape of the tray 10 at virtually all locations, except at the slot area 22. The bottom 12 and the upwardly extending sidewalls 14 are the same in both FIGS. 2 and 3, however, the step 16 and the rim 18 are unbroken in FIG. 2.

FIG. 3, which is a section through the tab 24 and slot 22 which are located along the center of the tray 10 in the preferred embodiment, shows the removal of a portion of the step 16 located outwardly of the bend 23 and the removal of virtually all of the rim 18 through the plane of the section to form the slot 22. The non-sectioning of the tab 24 shown in FIG. 2, illustrates the position of the tab 24 in the background. In FIG. 3 the tab 24 is shown sectioned and extending completely over the slot 22.

The releasably interlocking means of the present invention is operated in the following manner. A lid structure 25 shown in FIGS. 2 and 3 in phantom and which may be a flat paperboard sheet or other suitable lid known in the art having an outer edge shape which matingly conforms to the interior surface of the rim 18, is placed onto the step 16. The outer edge of the lid structure 25 is inserted under the tab 24. When the lid structure 25 is inserted under the tab 24, the bottom of the lid seats against the step 16. This provides a seal which is unbroken around the circumference of the tray 10. This seal prevents air and moisture from being transmitted between the inside of the closed container and the environment.

The tray 10 of FIG. 3 shows the presence of a substantial step 16 even at the area of the slot 22. The amount of the step 16 remaining, of course, depends upon the size of the slot 22, however, the greater the width of the step 16, the better the assurance of a seal between the step 16 and the lid structure 25.

It can be seen from FIG. 3 that the lid structure 25 may have only a peripheral edge functioning as a flange which can be inserted under the tab 24, or, in addition to the flange, may have a tab extending further out from the flange of the lid structure 25, under the tab 24 and through the slot 22. The tab on the lid structure 25 may be similar in shape to the tab 24 formed on the tray 10.

A large portion of the tray utilizing the present invention may be formed in a conventional manner. This entails compressing a generally flat paperboard blank between two typically heated dies to deform it into a desired shape. The preferred means of formation shown in FIG. 4 and FIG. 5 in cross-section uses the conventional series of dies, but additionally uses new elements to produce the slot and tab structure.

Figure 5:
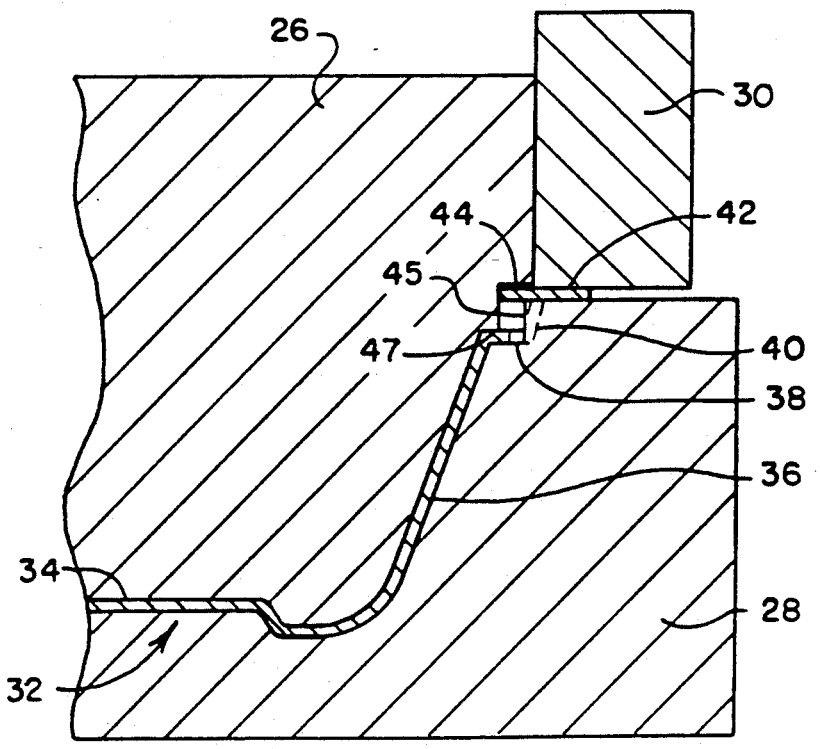
FIG. 5 is a section of the forming dies used to form the embodiment of FIG. 1 taken substantially through the center of the dies.

The present invention is formed using a set of dies comprising a punch die 26, a cavity die 28, and a draw ring die 30, all shown in FIGS. 4 and 5. FIGS. 4 and 5 correspond respectively to FIGS. 2 and 3 in that FIG. 4 is a section through the dies, spaced from the tab and slot area, and FIG. 5 is a section through the dies at the tab and slot area which is generally the center of the tray and therefore the center of the dies. FIG. 4 shows the punch die 26 extended fully into and matingly conforming to the cavity die 28, and compressing a paperboard tray 32 to its finished shape. The paperboard tray 32 in FIGS. 4 and 5 has, as in FIGS. 1, 2, and 3, a bottom 34, sidewalls 36 which extend upward from the bottom 34, a step 38 extending outwardly from the top of the sidewalls 36, a rim 40 extending upwards from the step 38, and a flange 42 extending outwardly from the rim 40.

FIG. 6 illustrates the general shape of the cuts made in the paperboard blank prior to deformation between the dies. The preferred embodiment of the cut shape comprises a long cut 46 generally parallel to the edge of the blank, a first pair of cuts 48 transverse to the long cut 46 and extending outwardly from it, and a second pair of cuts 50, which are generally parallel to the long cut 46, the second pair of cuts 50 extending away from each other.

In the formation of a tray using the present invention, a paperboard blank is precut with the series of cuts shown in FIG. 6 formed at the preferred location of the tab and slot means. In the preferred embodiment, these series of cuts are formed at each of two opposite ends of the blank.

The paperboard blank is deposited onto the cavity die 28 of FIGS. 4 and 5, the draw ring 30 and punch die 26 combination is forced downward, the draw ring 30 seats against the outer edge of the blank, and the punch die 26 compresses the interior portion of the blank. In the preferred embodiment, however, the portion of the blank immediately outwardly of the long cut 46 from FIG. 6 seats against a tab supporting block 45, shown in FIG. 5. Then, as the punch die 26 compresses the blank portion interior of the cuts 50 (from FIG. 6) downward, the tab 44 (shown in FIG. 5) is supported as coplanar to the flange 42. At the same time an outwardly protruding shoulder 47, which is formed on the punch die 26 in the region of and approximately co-extensive with the cuts 46, 48, and 50, seats against the blank and pushes the portion of the blank stop 16, which is inwardly of those cuts, downwardly against the step 38 of the cavity die 28. This causes the opening of the slot area directly beneath the tab 44. The tray 32, shown in FIGS. 4 and 5, is then removed from the dies in a conventional manner.

The primary advantage presented by the present invention is a continuous seating surface on the tray which is contained in one plane and against which a lid structure will seat in spite of the formation of a tab. The continuous seating structure produces a continuous seal with the lid structure around the entire circumference of the tray. This continuous seal prevents the communication of heat or air with the environment which may cause the contents of the container to be changed from their desired state. The tab 44 extends over and engages the peripheral flange or discrete tab formed on the lid to lock the lid in place and keep the contents within the tray 10.

While certain preferred embodiments of the present invention have been disclosed in detail, it is to be understood that various modifications may be adopted without departing from the spirit of the invention or scope of the following claims.

I claim:

1. In a food tray formed from a paperboard sheet and having, in an operable orientation, a horizontal bottom wall, sidewalls which extend upward from the edges of the bottom wall, a narrow step extending outwardly from the top of the sidewalls and encompassing the circumference of the tray, a rim extending upwards from the step and a flange which extends outwardly from the top of the rim, an improved releasably interlocking means comprising:

a slot formed outwardly of and spaced from a bend between the sidewall and the step, the slot being an aperture extending through the rim and up to the flange leaving a continuous coplanar step around the circumference of the container for continuously contacting a lid, and a tab which is integrally cut in said sheet and which extends from the flange inwardly and above the slotted region for releasably interlocking with a peripheral edge of a lid.

2. A paperboard food tray in accordance with claim 1 wherein there are at least two of said releasably interlocking means formed in each tray at opposite ends of the tray.

3. A paperboard food tray in accordance with claim 1 wherein the tab which extends inwardly from the flange has side edges which taper inwardly toward the tab's innermost edge.

* * * * *

UNITED STATES PATENT AND TRADEMARK OFFICE

CERTIFICATE OF CORRECTION

PATENT NO. : 5,083,699

DATED : January 28, 1992

INVENTOR(S) : David J. Bulcher

It is certified that error appears in the above-identified patent and that said Letters Patent is hereby corrected as shown below:

On the title page: , Item [54], the Title of the Invention, delete "INTACK" and insert therefor ---INTACT---.

In column 1, line 2, delete "INTACK" and insert therefor ---INTACT---.

Signed and Sealed this

Twenty-seventh Day of April, 1993

*Attest:*

MICHAEL K. KIRK

*Attesting Officer*

*Acting Commissioner of Patents and Trademarks*